United States Patent [19]

Stanislaw

[11] 4,256,537

[45] Mar. 17, 1981

[54] APPARATUS FOR STRETCHING AN ENDLESS WEB

[75] Inventor: Peter P. Stanislaw, Highland Lakes, N.J.

[73] Assignee: Morrison Machine Company, Paterson, N.J.

[21] Appl. No.: 57,201

[22] Filed: Jul. 13, 1979

[51] Int. Cl.[3] ..... D21F 7/00; D06C 3/06

[52] U.S. Cl. ..... 162/273; 26/51; 28/142; 162/274

[58] Field of Search ..... 162/273, 274; 26/106, 26/51; 28/142; 34/121

[56] References Cited

U.S. PATENT DOCUMENTS 3,596,372 8/1971 Hundseid ..... 26/106

*Primary Examiner*—Peter Chin

*Attorney, Agent, or Firm*—Lerner, David, Littenberg & Samuel

[57] ABSTRACT

Apparatus is provided for stretching and tensioning an endless web, such as a blanket or felt for papermaking machines. The apparatus includes a trackway having at least one movable stretch roll mounted thereon and movable relative to a work station for supporting and stretching the endless web or blanket. The movable roll is supported on a movable carriage arrangement at each end of the roll, with the carriage arrangement at one end including a first carriage section and a separable second carriage section. The first carriage section includes a device for lifting one end of the movable roll, and the second carriage section is connected to a saddle support which is pivoted into position to support the movable roll in the lifted position. The first carriage section is then disconnected from the second carriage section and is rolled away from its position under the movable roll. In this manner, the endless web can then be removed from the lifted end of the roll and replaced with another web. The process is then reversed to move the first carriage section back into position so that the movable roll can be lowered back onto the first carriage section.

9 Claims, 7 Drawing Figures

APPARATUS FOR STRETCHING AN ENDLESS WEB

FIELD OF THE INVENTION

The present invention relates generally to apparatus for stretching endless webs, such as blankets for papermaking machines, and specifically to an improved arrangement for lifting and supporting the stretch roll of such an apparatus, so that the endless webs may be easily changed.

BACKGROUND OF THE INVENTION

Apparatus for stretching, drying, and processing endless webs, such as blankets or wires for papermaking machines, typically include at least one stretch roll mounted for movement along tracks relative to a processing station, such as a loom or fixed roll, for processing the endless web while it is maintained under tension. Such stretch rolls are of massive size, such as 10 meters or more in length and more than 7 tons in weight. Therefore, it has been a particularly difficult problem to manipulate such rolls in order to remove the endless web after it has been processed and stretched, and to replace it with another endless web. To accomplish this in the past, the apparatus which supports the stretch roll must be moved to a cantilever arrangement, so that the endless web may be removed from the free end of the roll while it is being supported in the cantilever arrangement. All of such cantilever arrangements, whether they be a beam cantilever, a journal cantilever, or a saddle cantilever, require that the roll to be supported in the cantilever arrangement be moved to a particular location on the tracks where the cantilevering apparatus is located. Typical of such an arrangement is U.S. Pat. No. 3,596,372, issued on Aug. 3, 1971. In this arrangement, the stretch roll is mounted on stretch carriages which are moved to a position adjacent the drive roll when it is desired to remove the endless web. As the cantilever supporting apparatus is located adjacent to the drive roll, it is necessary to move the stretch roll to the drive roll when it is desired to remove the endless web. The cantilever arrangement is used to lift one end of the stretch roll and drive roll so that the endless web can be removed and replaced. As will be understood, such apparatus, as well as other prior art arrangements, require that the stretch carriages move the stretch roll to a predetermined position along the tracks in order to cantilever it so that the endless web can be removed. This, of course, utilizes valuable processing time and is therefore wasteful and inefficient.

Broadly, it is an object of the present invention to provide an improved arrangement which overcomes the aforesaid problems. Specifically, it is within the contemplation of the present invention to provide an arrangement for lifting and supporting an end of the movable roll so that the endless web can be removed therefrom at any point along the tracks, so that it is no longer necessary to return the stretch carriages and stretch roll to a predetermined position where the cantilever apparatus is located to remove the endless web.

It is a further object of the present invention to provide the carriages which move the stretch roll along the trackways with apparatus for lifting and supporting the stretch roll so that the endless web may be removed therefrom at any point along the trackway.

SUMMARY OF THE INVENTION

Briefly, in accordance with the principles of the present invention, an improved arrangement is provided for removing and changing endless webs on stretching apparatus or the like. The stretch roll is supported on a movable carriage arrangement, with the carriage arrangement including a first carriage section and a second carriage section disposed at the end of the stretch roll to be lifted. The first carriage section includes a device for lifting the end of the stretch roll, and the second carriage section is connected to a saddle support for supporting the stretch roll in the lifted position so that the endless web may be removed from the free end of the roll.

More particularly, the lifting device of the first carriage section lifts one end of the stretch roll and its bearing support and bearing. Lifting jacks on the first carriage section push against and lift the bearing support to lift it with the bearing and stretch roll. Then, a support saddle connected to the second carriage section is pivoted into position under the bottom of the stretch roll. The stretch roll is then lowered onto the support saddle so that the support saddle holds the weight of the stretch roll. Then the bearing support is lowered relative to the first carriage section leaving the bearing and end of the stretch roll suspended. The first carriage section is then disconnected from the second carriage section and moved out from under the end of the stretch roll. The stretch roll is supported approximately at its midpoint by the support saddle, so that the endless web can be removed from the free or suspended end of the stretch roll. Another endless web is then placed on the stretch roll, and the first carriage section is rolled back into position and reconnected to the second carriage section. Then the lifting device on the first carriage section is moved into its raised position to again lift the bearing support into engagement with the bearing and free end of the stretch roll so that the saddle support can be removed. The lifting device is then lowered, so that the stretch roll and new endless web are lowered back into their operating positions and are again supported by the first carriage section.

Advantageously, as a result of the present invention, apparatus is provided so that the endless web can be loaded and unloaded from the movable roll at any point along the trackways, and it is no longer necessary to return the movable roll and its supporting carriages to a predetermined position at which cantilevering devices are located. In accordance with the present invention, the roll lifting and supporting mechanism has been built into the carriage arrangement that moves the roll between its minimum and maximum stretch positions on the trackway.

BRIEF DESCRIPTION OF THE DRAWINGS

Further objects, features, and advantages of the present invention will become apparent upon the consideration of the following detailed description of a presently preferred embodiment when taken in conjunction with the accompanying drawings, wherein.

DETAILED DISCUSSION OF PREFERRED EMBODIMENT OF THE INVENTION

Figure 1:
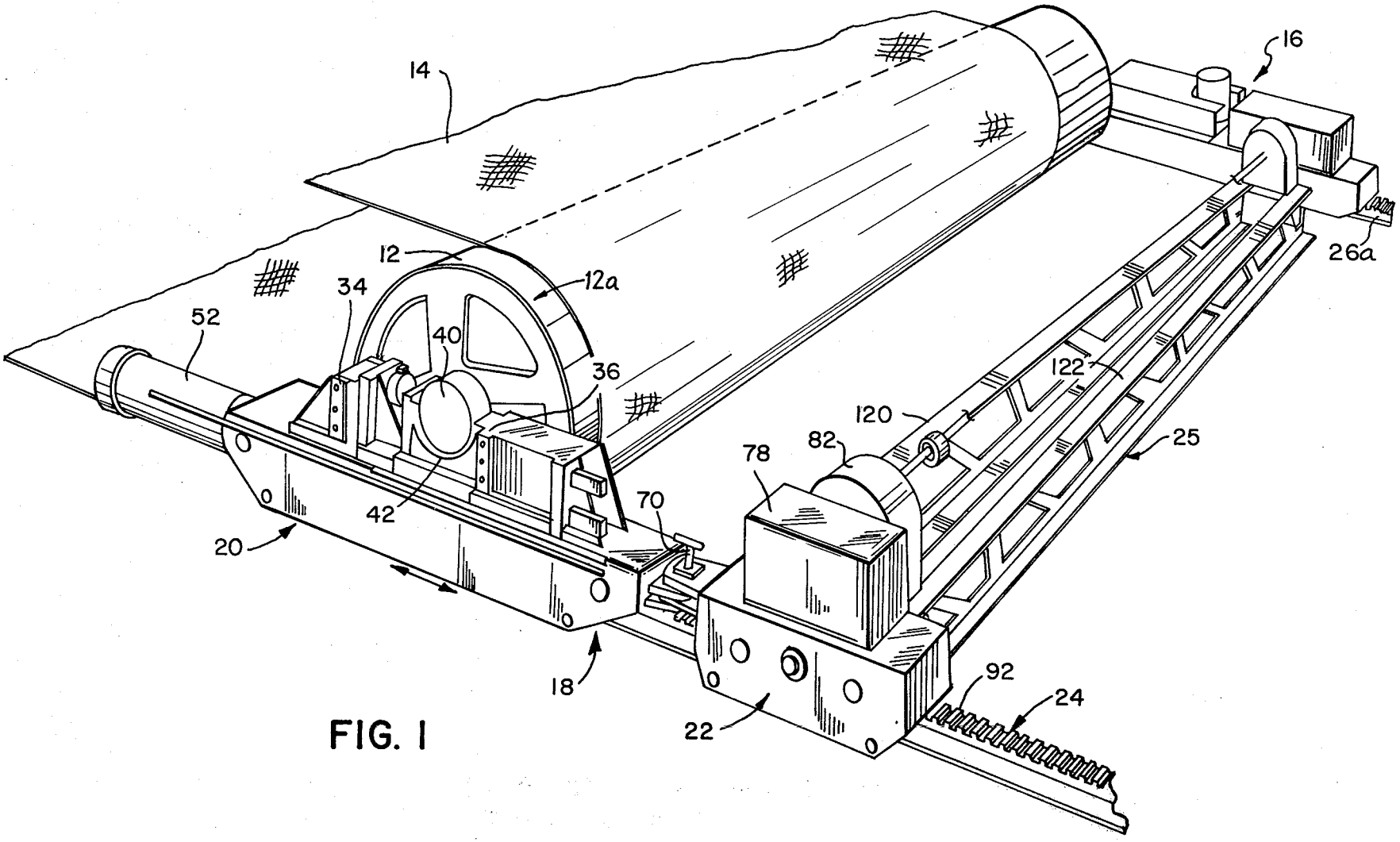
FIG. 1 is a perspective view of a stretching apparatus embodying the principles of the present invention.

Referring now to FIG. 1, there is shown the improved apparatus of the present invention, generally designated by the reference numeral 10, which includes a stretch roll 12 for supporting one end of an endless web 14. The other end of web 14 is supported by another roll (not shown) or suitable processing apparatus, such as a loom for processing the web. Stretch roll 12 is supported at one end by carriage 16 and at the other end by carriage 18. Carriages 16, 18 are movable along parallel tracks 24, 26 for moving stretch roll 12 between its minimum and maximum stretching positions for stretching web 14. When web 14 has been stretched to its desired length, and any necessary processing has been completed, carriages 16, 18 are moved a few feet to release the tension on web 14 so that it can be removed. Then, it is necessary to lift the end **12*a* of stretch roll 12 so that web 14 can be removed from stretch roll 12 and be replaced with a new web to be stretched. As will be explained herein, carriage 18 includes a first carriage section 20 and a second carriage section 22 disposed at the end 12*a* of stretch roll 12. In addition, as will be explained herein, first carriage section 20 includes the apparatus for lifting stretch roll 12, whereas second carriage section 22 is connected to a support member 25 which supports a movable saddle 26 for supporting stretch roll 12 in its lifted position, so that endless web 14** may be removed therefrom.

First carriage section 20 includes a frame 30 and wheels 32 for riding on tracks 24. In addition, frame 30 includes side support elements 34, 36 which are part of the frame and are not lifted with the roll 12. As will be seen in FIG. 2, the end of roll 12 is supported in a bearing 40 and a U-shaped bearing support 42. In order to lift roll 12, bearing 40, and bearing support 42, suitable jacking apparatus 50 is provided on carriage 32. Jacking apparatus 50 includes a motor 52 connected to a shaft 54 for driving a first screw jack 56 which is connected by universal shaft 58 to a second screw jack 60. Screw jacks 56, 60 include respective screw elements 62, 64 and respective nut elements 66, 68. In this manner, when motor 52 is actuated to operate screw jacks 56, 60, they operate to lift bearing support 42, bearing 40, and roll 12 relative to carriage section 20. As will also be noted, carriage section 20 is removably connected to carriage section 22 by a retractable pin arrangement 70 which engages flanges 72 formed on carriage 20 and flanges 74 formed on carriage 22. When flanges 72, 74 are interlineated, retractable pin 70 is inserted in the flanges to hold the two carriages together so that they move as a unit.

Figure 2:
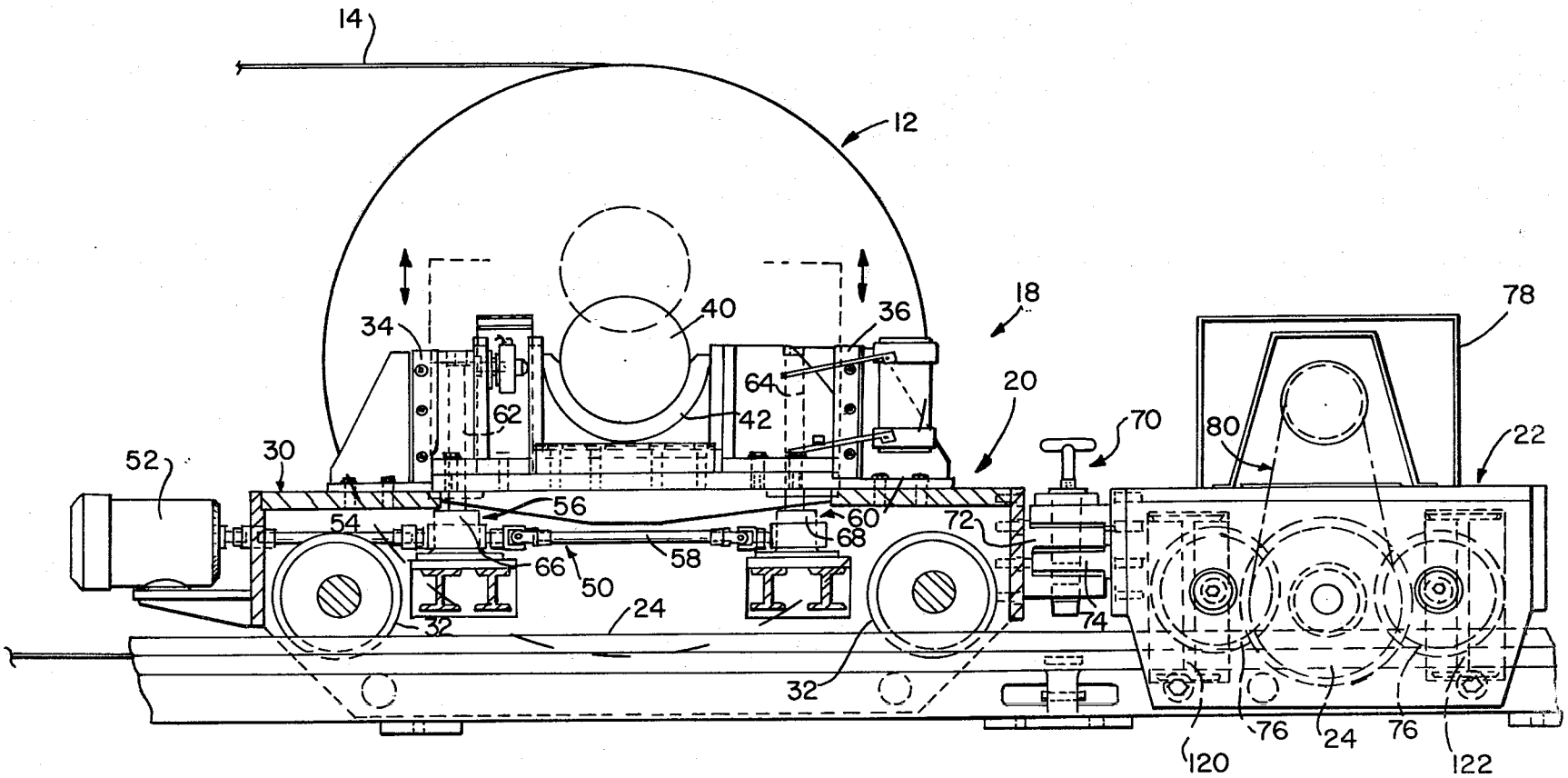
FIG. 2 is a side elevational view of the first and second carriage sections.
Figure 4:
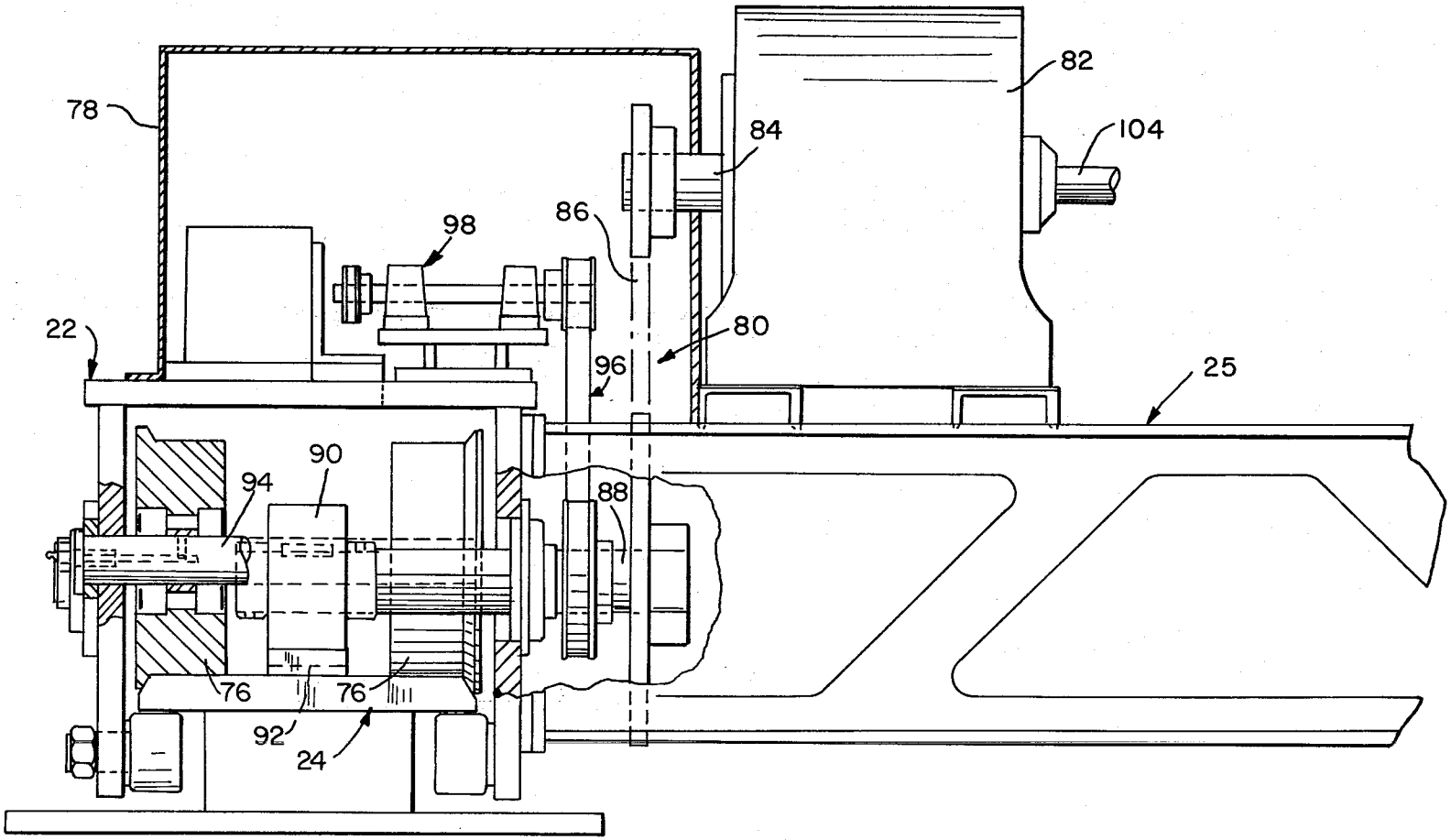
FIG. 4 illustrates in detail the driving arrangement of the second carriage section.

Referring to FIG. 2, the second carriage section 22 includes wheels 76 for riding on trackway 24. In addition, it includes an upper cover member 78 which covers a driving arrangement 80 which is shown more clearly in FIG. 4. As seen in FIG. 4, support member 24 connected to carriage section 22 supports a gear reducer 82 having an output shaft 84 which drives a chain or belt 86 for driving a wheel fixedly mounted on a shaft 88. Shaft 88 is connected to and drives a pinion 90 which engages a rack member 92 mounted on track 24 for driving carriage 22 along the track. The wheels 76 are mounted on an axle 94 which is partially shown. As also shown, shaft 88, through a drive 96, drives an encoder assembly 98 which provides an indication of the location of the carriage relative to the trackway.

Figure 3:
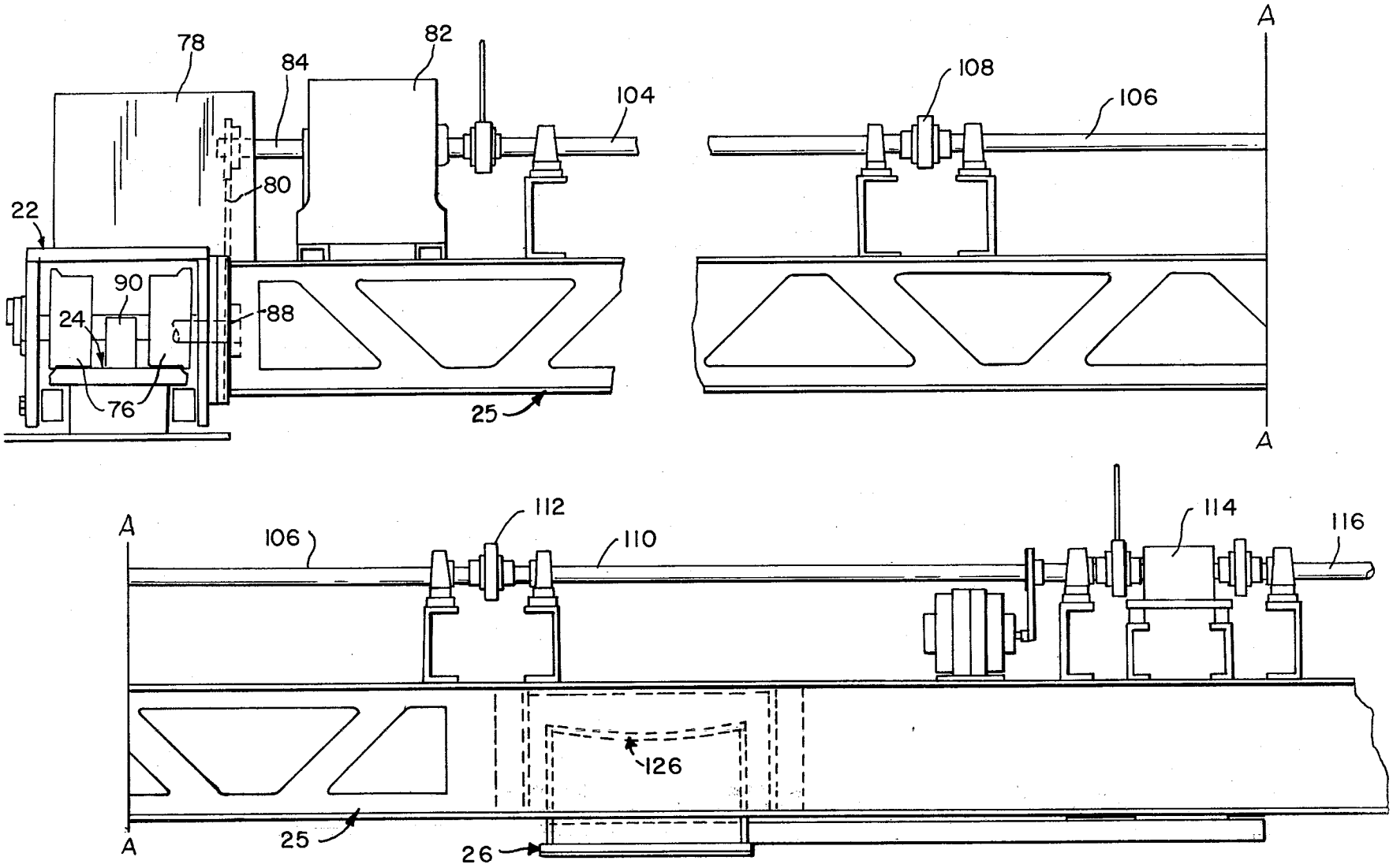
FIG. 3 is a side elevational view of the second carriage section and its connection to the drive arrangement and saddle support.

Referring now to FIG. 3, the input drive to gear 82 is clearly illustrated. More particularly, gear reducer 82 receives its driving input from shaft 104 and shaft 106 which are drivingly connected by a suitable coupling 108. In addition, shaft 110 is drivingly connected to shaft 106 by a suitable coupling 112. As will be noted, shaft 110 is driven by a motor and gear reducing arrangement 114 which thereby operates to drive shaft 88 and pinion 90 relative to rack 92 to drive carriage sections 20, 22. In addition, drive arrangement 114 also provides a driving output through shaft 116 to carriage 16 on the other side of stretch roll 12 in a similar manner so that carriage 16 is movable along trackway 26. As will also be seen in FIG. 3, support member 24, which consists of two parallel I-beams 120, 122 extending from carriage 22 to carriage 15, supports movable saddle 26 which, as will be explained, supports stretch roll 12 in its lifted position.

Figure 5:
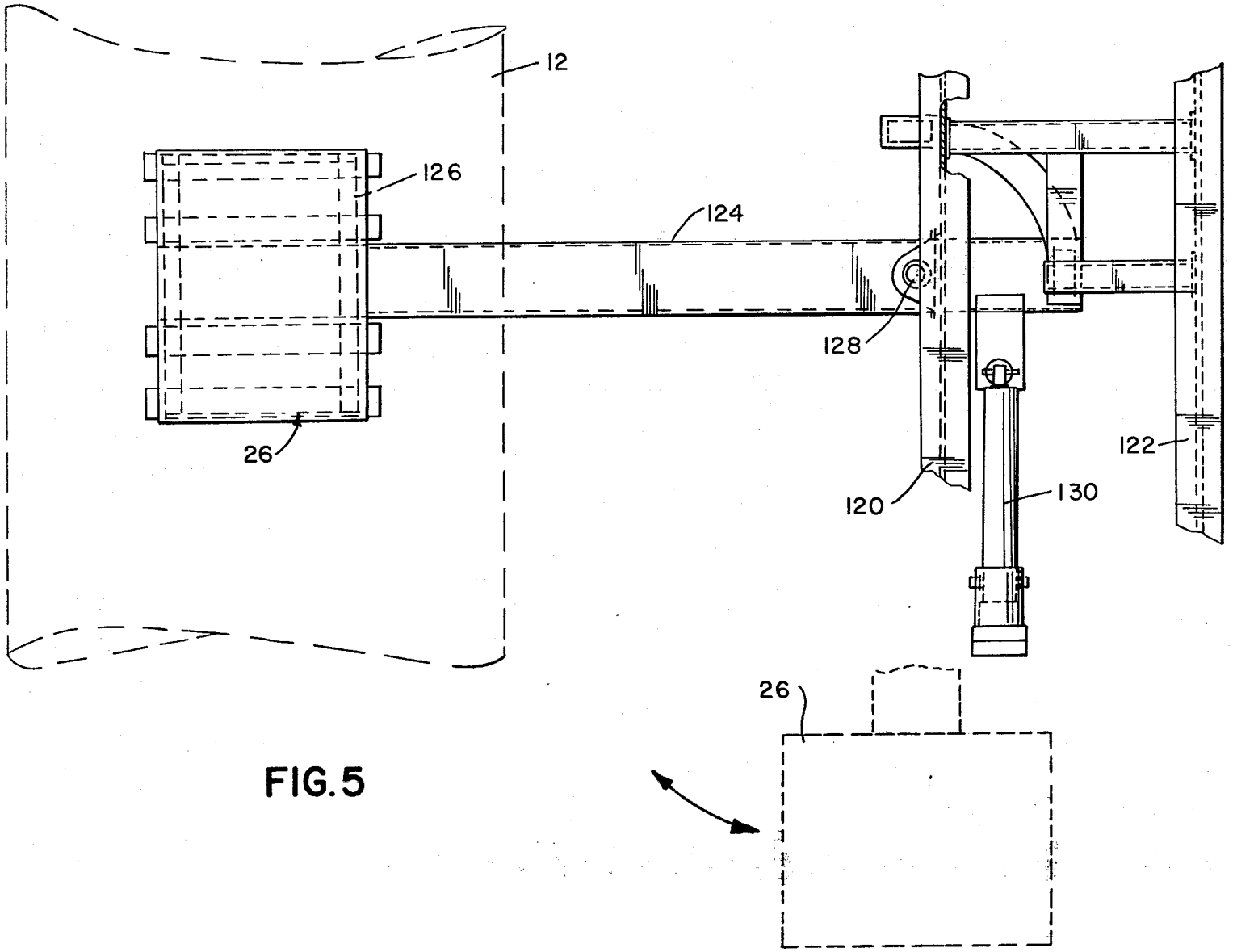
FIG. 5 is a plan view illustrating the pivoting support saddle.
Figure 6:
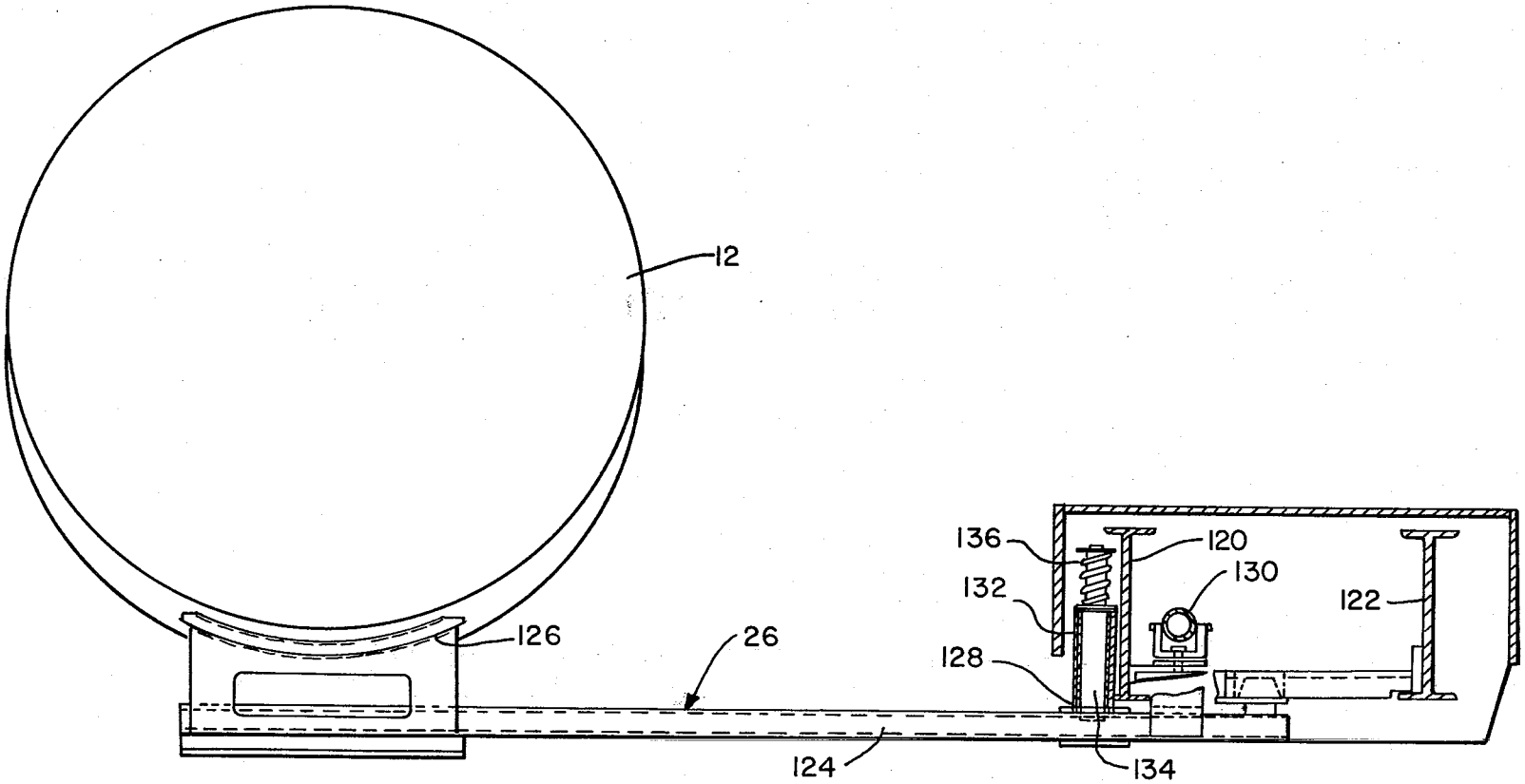
FIG. 6 is an elevational and sectional view illustrating in further detail the support saddle.

Referring now to FIGS. 5 and 6, movable saddle 26 is more clearly illustrated. As will be noted, movable saddle 26 is connected to and supported on the bottom of the parallel I-beams 120, 122. In particular, support saddle 26 includes an elongated arm 124 and a support bed 126 for engaging the underside of stretch roll 12. In addition, arm 124 is pivotally connected at 128 to I-beam 120. In order to actuate saddle 26 from its inoperative position, shown in dotted lines, to its operative position, shown in solid lines, a suitable jack arrangement 130 is provided, which can be of any type, such as a hydraulic jack or air jack. As will be understood, after stretch roll 12 has been lifted by screw jacks 56, 60, jack arrangement 130 is actuated to pivot support saddle 26 from its inoperative position to its operative position under stretch roll 12. Stretch roll 12 is then lowered by the screw jacks onto the support saddle 26 so that the saddle holds the weight of the stretch roll 12 and so that the end **12*a* of the stretch roll is suspended well above carriage 22. Referring to FIG. 6, it will be noted that the pivot point 128 includes a sleeve 132 vertically slideable on a shaft 134 against a spring 136. Accordingly, such an arrangement allows for movement of saddle arm 26 when receiving and releasing the weight of stretch roll 12**.

Figure 7:
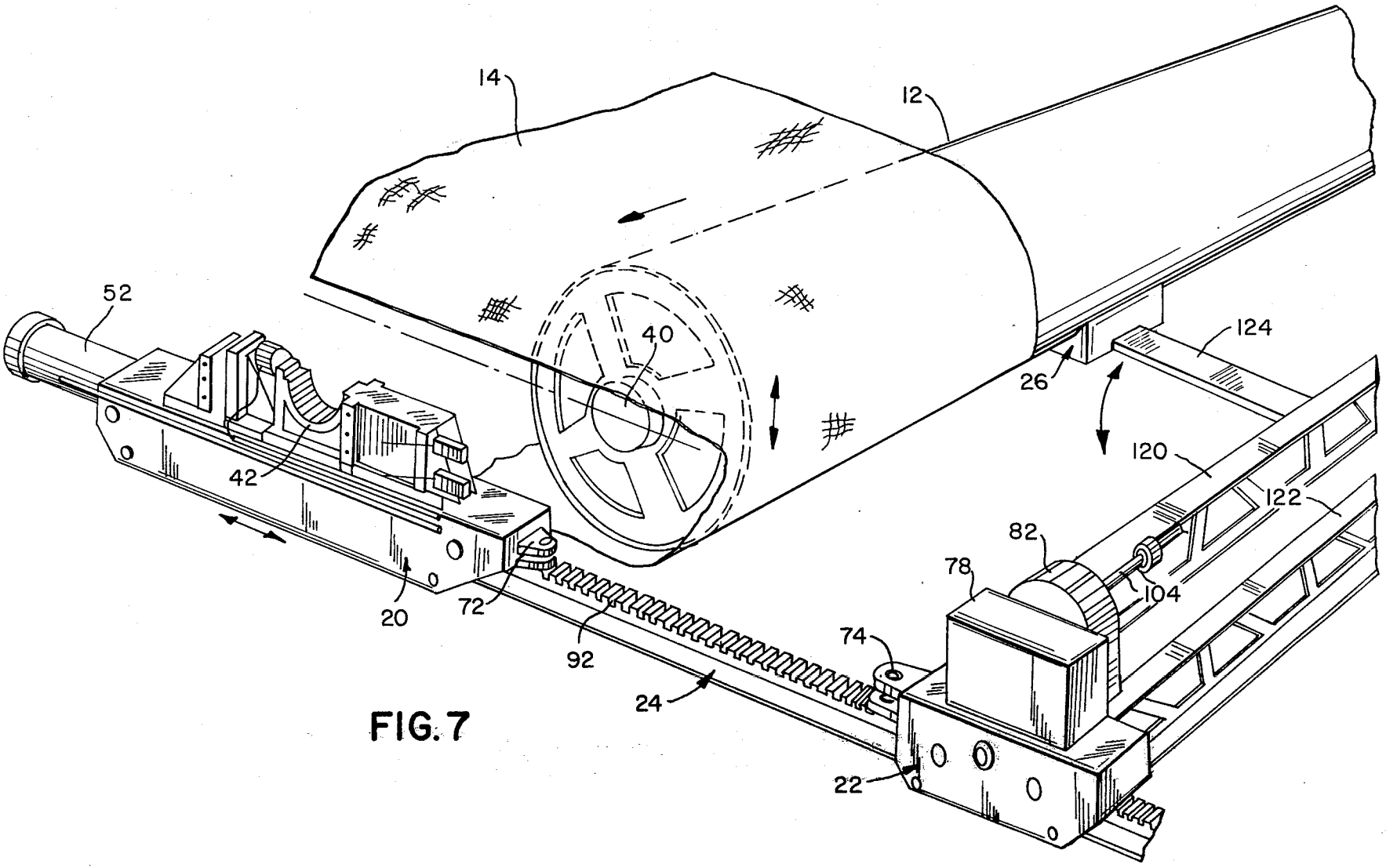
FIG. 7 is a perspective view illustrating the stretch roll in its lifted position for removal of an endless web.

Referring now to FIGS. 1 and 7, the operation of the present invention will now be explained. After the processing of endless web 14 has been completed, carriages 16, 18 are moved a few feet to the right to release the tension on the web so that it can be removed from the stretch roll 12. At this position, without the need of moving the carriages to a location having a cantilevering arrangement, the screw jacks 56, 60 of first carriage sections 20 are actuated via motor 52 to lift the bearing support 42, bearing 40, and stretch roll 12 relative to carriage section 20. Then, jack arrangement 130 is operated to move support saddle 26 from its inoperative position to its operative position under the lifted stretch roll with the endless web 14 moved out of the path of the support saddle 26, as shown in FIG. 7. The screw jacks 56, 60 are then operated to lower the stretch roll 12 onto the support bed 126 of support saddle 26 so that the support saddle then holds the weight of the stretch roll 12. Screw jacks 56, 60 are then further lowered to lower the bearing support 42 onto the carriage section 20 leaving bearing 40 and roll 12 suspended. Retraction pin 70 is then actuated to disconnect carriage sections 20, 22, and carriage section 20 is moved along trackway 24 to a position so that it is no longer under the stretch roll 12. The endless web 14 can then be removed from the free or suspended end 12*a* of the stretch roll 12. Another endless web is then placed on the stretch roll, and the first carriage section 20 is rolled back into position and reconnected to the second carriage section 22 by reinserting retractable pin 70 into interconnected flanges 72, 74. Screw jacks 56, 60 are then operated to lift the bearing support 42 into engagement with the bearing 40 and free end of the stretch roll 12, so that the saddle support 26 can be moved out from under the stretch roll 12 and into its inoperative position, and the new endless web moved into its normal operating position as shown in FIG. 1. Screw jacks 56, 60 are then lowered so that the entire assembly and new endless web are lowered back into their operating positions and are again supported by the carriage section 20.

In view of the foregoing, it should be appreciated that as a result of the present invention, apparatus has been provided which allows the endless web 14 to be loaded and unloaded from the movable stretch roll 12 at any point along the trackways 24, 26, and it is no longer necessary to return the movable stretch roll and its supporting carriages 16, 18 to a predetermined position at which cantilevering devices are located.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Apparatus for processing an endless web, comprising:

support means for supporting said endless web at a first location thereof;

a roll for supporting said endless web at a second location thereof;

track means extending between said first and second location, movable carriage means for rotatably supporting said roll in a normal operating position and moving said roll relative to said support means along said track means;

said carriage means including a first carriage section and a second carriage section said first and second carriage section being in engagement with said track means at one end of said roll;

said first carriage section including first roll support means for lifting said one end of said roll to a position above said normal operating position independent of the location of said movable carriage means relative to said support means; and said second carriage section including second roll support means for maintaining said roll in said lifted position without the support of said first roll support means so that said endless web may be removed from said roll.

2. Apparatus in accordance with claim 1, further including means for removably connecting said first and second carriage sections.

3. Apparatus in accordance with claim 1, wherein said first roll support means includes at least one jack for engaging and lifting said end of said roll.

4. Apparatus in accordance with claim 1, wherein said second roll suppport means includes a support arm extending from said second carriage section, and a movable saddle element supported on said support arm for engaging the underside of and supporting said roll in said lifted position.

5. Apparatus in accordance with claim 1, wherein said carriage means includes a third carriage section disposed at the other end of said roll in engagement with said track means.

6. Apparatus in accordance with claim 5, wherein said second roll support means includes a support arm connecting said second and third carriage sections and extending parallel to said roll and movable therewith, and a movable saddle element supported on said support arm for engaging the underside of and supporting said roll in said lifted position.

7. Apparatus in accordance with claim 6, further including drive means for said carriage means supported on said support arm and movable therewith.

8. Apparatus for processing an endless web, comprising:

support means for supporting said endless web at a first location thereof;

a roll for supporting said endless web at a second location thereon, said roll including bearings at both ends;

track means extending between said first and second location;

movable carriage means for rotatably supporting said roll in a normal operating position and moving said roll relative to said support means along said track means, said carriage means being in engagement with said track means;

said movable carriage means including first roll support means for lifting the end of said roll associated with one of said bearings to a position above said normal operating position independent of the location of said movable carriage means relative to said support means, and second roll support means for maintaining said end of said roll at said position above said normal operating position without the support of said first roll support means to free one end thereof so that said endless web may be removed from said roll.

9. Apparatus in accordance with claim 8, wherein said movable carriage means includes a first carriage section including said first roll support means and a second carriage section including said second roll support means, and further including means for removably connecting together said first and second carriage sections.

* * * * *